US008944964B1

(12) United States Patent
Saffaie

(10) Patent No.: US 8,944,964 B1
(45) Date of Patent: Feb. 3, 2015

(54) HAND GRIP EXERCISE ARRANGEMENT

(76) Inventor: Michael Saffaie, Rancho Palos Verdes, CA (US)

( * ) Notice: Subject to any disclaimer, the term of this patent is extended or adjusted under 35 U.S.C. 154(b) by 68 days.

(21) Appl. No.: 12/228,831

(22) Filed: Aug. 18, 2008

(51) Int. Cl.
*A63B 53/14* (2006.01)

(52) U.S. Cl.
USPC ..... 482/44; 482/91

(58) Field of Classification Search
USPC ..... 482/49, 82, 126, 7, 37, 35, 44, 91
See application file for complete search history.

(56) References Cited

U.S. PATENT DOCUMENTS

| | | | | | |
|---|---|---|---|---|---|
| 325,987 | A | * | 9/1885 | Sparks | 482/109 |
| 412,479 | A | * | 10/1889 | Davis | 264/271.1 |
| 906,303 | A | * | 12/1908 | Sapper | 482/82 |
| 1,137,349 | A | * | 4/1915 | Patterson | 482/127 |
| 1,409,142 | A | * | 3/1922 | Gerson | 74/551.9 |
| 1,585,748 | A | * | 5/1926 | Wendelken | 482/143 |
| 1,790,267 | A | * | 1/1931 | Gordon | 482/49 |
| 1,942,922 | A | * | 1/1934 | Gerow | 473/206 |
| 2,537,488 | A | * | 1/1951 | Stoner | 43/18.1 R |
| 2,628,100 | A | * | 2/1953 | Beebe | 473/203 |
| 2,683,603 | A | * | 7/1954 | Gackenbach | 473/613 |
| 2,817,187 | A | * | 12/1957 | Auzin | 446/184 |
| 3,306,612 | A | * | 2/1967 | Rosen | 273/440 |
| 3,347,545 | A | * | 10/1967 | Nichols | 472/51 |
| 3,396,967 | A | * | 8/1968 | Brown | 482/46 |
| 3,601,923 | A | * | 8/1971 | Rosenberg | 446/267 |
| 3,825,252 | A | * | 7/1974 | Geiger | 482/129 |
| 3,837,642 | A | * | 9/1974 | Martin | 482/38 |
| 3,915,782 | A | * | 10/1975 | Davis et al. | 156/294 |
| 4,040,619 | A | * | 8/1977 | Landi | 482/49 |
| 4,168,060 | A | * | 9/1979 | Hohenfeldt | 482/10 |
| 4,222,560 | A | * | 9/1980 | Hallerman | 482/49 |
| 4,227,688 | A | * | 10/1980 | Senoh et al. | 482/38 |
| 4,291,871 | A | * | 9/1981 | Lippert | 482/46 |
| 4,351,526 | A | * | 9/1982 | Schwartz | 482/108 |
| 4,570,925 | A | * | 2/1986 | Kock et al. | 482/46 |
| 4,637,606 | A | * | 1/1987 | Hunn | 482/82 |
| 4,647,037 | A | * | 3/1987 | Donohue | 482/82 |
| 4,867,444 | A | * | 9/1989 | Castillo | 482/106 |
| 4,964,192 | A | | 10/1990 | Marui | 16/111 |
| 5,029,850 | A | | 7/1991 | Van Straaten | 272/137 |
| 5,135,455 | A | * | 8/1992 | King et al. | 482/108 |
| 5,158,255 | A | * | 10/1992 | Fuller | 248/118 |
| 5,302,165 | A | * | 4/1994 | Caruthers | 482/108 |
| 5,326,340 | A | * | 7/1994 | Coffey | 482/93 |
| 5,427,376 | A | * | 6/1995 | Cummings et al. | 473/201 |
| 5,572,941 | A | * | 11/1996 | Arnos | 112/475.06 |
| 5,718,655 | A | * | 2/1998 | Phillips | 482/49 |
| 5,797,165 | A | | 8/1998 | Armbrust | 16/111 |
| 5,820,522 | A | * | 10/1998 | Smallwood et al. | 482/49 |
| 5,839,992 | A | * | 11/1998 | Phillips | 482/49 |

(Continued)

FOREIGN PATENT DOCUMENTS

CH 666409 7/1988

OTHER PUBLICATIONS

Drugstore.com: Perfect Pullup (Internet).

(Continued)

*Primary Examiner* — Stephen Crow
*Assistant Examiner* — Rae Fischer
(74) *Attorney, Agent, or Firm* — Robert R. Meads

(57) ABSTRACT

An exercise device for exercising the grip muscles of the hand and auxiliary muscles used in gripping by simultaneous isometric exercise of the hand muscles while exercising other muscles isotonically.

4 Claims, 2 Drawing Sheets

(56) References Cited

U.S. PATENT DOCUMENTS

| | | | | |
|---|---|---|---|---|
| 5,891,000 | A * | 4/1999 | Phillips | 482/49 |
| D415,858 | S * | 10/1999 | Funatogawa | D28/56 |
| 6,022,299 | A | 2/2000 | Stewart | 482/102 |
| 6,276,647 | B1 * | 8/2001 | Stopper | 248/118.5 |
| 6,540,645 | B1 * | 4/2003 | Zeilinger | 482/35 |
| 6,941,954 | B1 * | 9/2005 | Belcher | 132/73 |
| 7,108,636 | B1 | 9/2006 | Garcia | 482/40 |
| 7,118,491 | B2 | 10/2006 | Mootoo | 473/290 |
| 7,175,572 | B2 * | 2/2007 | Stonecipher | 482/106 |
| 2005/0277520 | A1 | 12/2005 | Waes | |
| 2007/0287614 | A1 * | 12/2007 | Fuller | 482/121 |
| 2008/0040891 | A1 | 2/2008 | Tyler | |
| 2009/0197742 | A1 * | 8/2009 | Hartman | 482/50 |

OTHER PUBLICATIONS

Fitness Equiment Source: Revolving Stirrup Handle W/Rubber Grip (Internet).

* cited by examiner

HAND GRIP EXERCISE ARRANGEMENT

BACKGROUND OF THE INVENTION

1. Field of the Invention

This invention relates to the muscle exercise and strengthening art and more particularly to an apparatus and a method for providing progressive hand grip strengthening.

2. Description of the Prior Art

The benefits of progressive, resistive weight increases in the exercise of various muscles is well known. That is, in exercising particular muscles or muscle groups to provide increased muscle size and, thus, increased muscle strength, an exercise is selected for exercising that muscle group, termed target muscles, by performing the exercise on a particular exercise equipment or apparatus. The exerciser selects multiple, periodic exercise sessions for each targeted muscles. In each session, the exerciser performs a preselected number of repetitions of the exercise a predetermined number of times of sets of the repetitions. Thus, for example, the number of repetitions of a particular exercise may be eight to twelve and the number of sets of these repetitions may be eight to twelve and the number of these eight to twelve repetitions may be three, though greater of fewer repetitions and/or sets may be selected as desired. In each repetition, the targeted are exercised in an isotonic mode. That is, the muscles are moved in a particular path with the movement of the body part to which the target muscles are attached. As the strength of the target muscles is increased, the resistance weight is periodically increased to provide to the desired increase in size and strength. In performing those exercises in which the hands of the exerciser are used to grasp the exercise equipment, such as a dumbbell or a bar bell, or a handle connected to a resistance weight of an exercise equipment, such as in various cable exercise equipments, pull up bars, or other various exercise equipments or apparatuses, the hands of the exerciser are placed on the selected equipment and/or the handle used on the exercise equipment in usually one of two main grip positions. These two grip positions are termed the "C" grip, in which the tip of the thumb of the hand is in opposed relationship to the tips of the fingers such that, depending on the size of the object being gripped, the profile of the hand is in the form of the letter "C". In the "C" grip, the opposed thumb and the base of the palm form the gripping action therebetween. The other of the two basic grip positions is termed the "Monkey Grip". In the Monkey Grip, the thumb is opened up from the "C" position and is aligned along a portion of the side of the index finger. Gripping action of the hand is provided mainly between the fingers and the palm of the hand. In either type of grip, during the performance of the exercise, the muscles of the hand and/or associated wrist and forearm muscles do not move relative to any body part. Such resistance movement is termed an isometric exercise. Such exercise of muscles in the isometric mode has been done heretofore for the target muscles, but the desired increase in muscle size and strength has not, in general, resulted from such limited isometric exercising.

Consequently, in performing the desired exercise in which the hand is utilized to provide the grip to the exercise equipment, while the targeted muscles are exercised in an isotonic mode, the grip muscles are exercised in an isometric mode.

Various types of exercise for the hand/grip muscles have heretofore been proposed. Such grip muscle exercising was done by having the hand squeeze a resilient object such as a sponge ball, spring loaded squeeze devices or the like. While such exercising of the grip muscles has had limited success in increasing the grip strength of the grip muscles, it has not been able to provide the large increase in grip strength at all position of the hand that is often desired.

It is known that as the fingers of the hand are gradually closed from the fully extended position wherein the fingers are aligned with and substantially co-planar with the palm, to a closed position, in which the hand is in a fist, in either the "C" grip or the "Monkey Grip", the grip generally becomes stronger until, as a first is made, the grip strength is at its strongest. Conversely, as the fingers are opened up from a first position to the fully extended position, the grip becomes less strong until the fingers are nearly completely opened wherein the grip is at the weakest. At the fully extended position there is no grip strength since there is, by definition, no opposed members to provide a grip.

Thus, there has long been a need for both a structure or apparatus that may be utilized to exercise and develop the muscles in the forearm, hand and wrist so that the strength of the grip at any degree of the fingers being opened is increased as well as a program using the apparatus so as to provide progressive increases in the grip strength.

Grip strength at various degrees of openness of the hand is important in many sport activities. For example, in many martial arts, the gripping of an opponent's garment during a bout wherein the type of garment, the amount of garment grasped, and like factors, dictate the degree of openness of the hand, is part of the sport. Similarly, the use of the hands in defense in football and other sports often requires grasping with various degrees of openness of the hand. In many other activities wherein the degree of openness is fixed during the activity such as the grasping of a fishing pole, a pole vault pole, a tennis racquet, a baseball bat or a golf club, and in many throwing activities, such as throwing a football, a baseball, a javelin or the like, the grip strength at the required hand position is important for accuracy and control and it is desired to have the maximum strength of the grip at that hand position. Grip strength is also important in rope climbing and can be life saving in activities such as mountain climbing. Grip strength is also important in many more mundane activities such opening jars, grasping tools such as a hammer or screw driver, or the like.

It has been found that gripping, for example a cylindrical or other hand graspable geometric cross sectioned device by the hands, such a horizontal bar, as in performing a pull-up exercise, the body weight is fixed and generally cannot be increased over time. The targeted muscles for the pull-up are, in general, the upper back muscles, which muscles are increased in strength over time by increasing the number of repetitions and the number of sets performed. The hand is usually in a "C" grip position, though a "Monkey Grip" position may also be used, in a pull-up. The diameter of the horizontal bar is fixed so that the hands are in a fixed position of gripping and thus not exercised in an isotonic mode but in an isometric mode in the pull-up exercise. Such relationship of the isotonic exercising of the targeted muscle group and the isometric exercising of the grip muscles is standard for other exercises wherein the gripped handle or equipment is a fixed dimension. The grip strength of the hand is only strengthened for the one position of the hand due to the isometric exercising thereof.

Since there are a large number of targeted muscles to be exercised, the time required to exercise all of the targeted muscles increases as muscle specific exercises are developed which is a disadvantage due to the increased time required to exercise properly all the desired targeted muscles.

Thus, there has long been a need for an exercise device or apparatus and method of use thereof that will allow exercising the hand grip muscles while at the same time exercising the targeted muscle group so that such exercises are accomplished without increased exercising time. Further, such exercise device should be capable of being attachable either fixedly or removably to be used as handles on more conventional exercise equipments such as dumbbells, bar bells, the cables of cable machines, T-Bar machines and the like of the type found in many health clubs and gymnasiums.

Accordingly, it is an object of the present invention to provide an improved exercise device for exercising the grip muscles of the hand.

It is another object of the present invention to provide an improved exercise device for exercising the grip muscles of the hand to increase grip strength at any degree of openness of the hand.

It is another object of the present invention to provide an improved exercise device for exercising the grip muscles of the hand to increase grip strength at any degree of openness of the hand and which exercise device may be utilized on a wide variety of other exercise equipments and machines.

It is another object of the present invention to provide an improved set of exercise devices for exercising the grip muscles of the hand to increase grip strength at any degree of openness of the hand and which exercise devices may be utilized on a wide variety of other exercise equipments or machines and which exercise devices may be provided in a plurality of various sizes.

It is yet another object of the present invention to provide an improved set of exercise devices for exercising the grip muscles of the hand to increase the grip strength at any degree of openness of the hand and which set of exercise devices may be sequentially utilized in a preselected order on a wide variety of other exercise devices.

It is yet another object of the present invention to provide an improved exercise device for exercising the grip muscles of the hand to increase grip strength at any degree of openness of the hand and which exercise device may be utilized on a wide variety of other exercise devices and wherein the grip strength of the hand is increased simultaneously with the increase of the strength of the targeted muscle for the particular exercise being performed.

It is another object of the present invention to provide an improved exercise device for exercising the grip muscles of the hand to increase grip strength at any degree of openness of the hand while performing a preselected exercise on a preselected exercise equipment to exercise a targeted muscle group and during the performance of the preselected exercise the targeted muscles are exercised in an isotonic mode and the hand muscles are exercised in an isometric mode.

It is still another object of the present invention to provide a method and program for utilizing an exercise device for exercising the grip muscles of the hand to provide a progressive increase in the grip strength of the hand at any degree of openness of the hand over a time period of such use.

It is still another object of the present invention to provide a method and program for sequentially utilizing one or a pair of a plurality of exercise devices of progressively larger exercise devices which may be attached to an exercise equipment or machine for performing a preselected exercise and in the performance of the preselected exercise simultaneously exercising preselected target muscles in an isotonic mode and exercising the grip muscles of the hand in an isometric mode to provide a progressive increase in the grip strength of the hand at any degree of openness of the hand over a time period of such use.

SUMMARY OF THE INVENTION

The above and other objects of the present invention are achieved, in a preferred embodiment thereof, by providing a plurality of hand graspable exercise devices and the plurality of hand graspable exercise devices may be in matched pairs for utilization in simultaneously exercising matching parts of the body. For example, in performing the pull-up exercise, according to the principles of the present invention, a pair of the exercise devices are attached to a horizontal bar of an exercise equipment or apparatus and each of the hands of the person performing the exercise grasps one of the exercise devices. The muscles of the upper back are the targeted muscle group for the pull-up exercise. Each of the devices of the present invention may be cylindrical in shape and may have one or more separate portions. For example, the device may have two portions with a co-linear central axis and the diameters of the each portion may be different to provide a first diameter of one size and a second diameter of a larger size. The devices of this embodiment of the present invention are provided in a plurality of matched pairs. The diameters of the corresponding portions of each of the pairs are progressively larger so that the smallest diameter of the smallest pair of the devices provides a circumference that allows a grip that is about a closed "C" grip and the largest diameter of the largest pair of devices provides a grip that is about as close to an open "Monkey Grip" that still allows gripping action.

One end of each device, such as the portion having the larger of the two diameters, is provided with a connection structure that allows rotation of the device about the central axis as well as connection to the selected exercise equipment or apparatus.

As utilized herein, the term "exercise device" refers to the devices that are fabricated in the configuration according to the principles of the present invention and utilized in the method and program described. The term "exercise equipment" refers to the various types of exercise equipments and the variety of apparatuses found in health clubs, gymnasiums and like establishments and to which the exercise devices of the present invention may be attached. The term "targeted muscle" or "targeted muscle group" refers to the muscles that are selected for exercise in the performance of a particular exercise on a particular exercise equipment.

For purposes of example in the configuration and the use of the exercise devices, the following description describes the use in a pull-up exercise performed with the exercise devices attached to a horizontal bar in a spaced relationship. However, the exercise devices are not limited to use in just the exercise of a pull-up, but may be utilized similarly in a variety of exercises on a variety of exercise equipments and in which exercises both or only one hand may be used to grasp an exercise device. For example, in performing a dumbbell row exercise, only one hand at a time is utilized.

In a pull-up, a matching pair of the devices is removably connected by the connection structure to the horizontal bar of a pull-up exercise equipment in any desired separation therebetween and with the central axis of the devices in the vertical direction. In addition to the pivotal motion about the central axis, the connection to the horizontal bar also allows rotation about the axis of the horizontal bar. The targeted muscle group to be exercised by a pull-up exercise is the upper back muscles, but in utilizing the devices of the present invention the grip muscles are also exercised to provide an increased grip strength at various degrees of openness of the hand. In the conventional hand position for a pull-up, the hands are wrapped around the horizontal bar in a "C" grip (or "Monkey Grip" as may be desired) with the fingers in a horizontal array alignment. In the use of the devices of the present invention in a pull-up exercise, the fingers are aligned in a substantially vertical array alignment.

The user commences a program of use of the exercise devices by starting with a pair of the devices at the smallest diameters, e.g. one inch, and performs a pull-up exercise. In each repetition of the exercise, the target muscles, that is the upper back muscles, are exercised in the isotonic mode and the hand gripping muscles are exercised in the isometric mode. Once the grip strength has been increased so that the desired number of repetitions and sets are performed, the exerciser progressively commences using exercise devices and the portions thereof of increasing diameter. At the use of the devices at each diameter, the exercise is repeated until the desired number of repetitions and sets is accomplished. The change to the next largest diameter of device is then repeated until the largest diameter is selected and in which the hand is in the desired widest open gripping position and the grip strength at any degree of the hand being open has been increased.

In the preferred embodiments of the present invention, each of the devices has a substantially rigid body member and a softer outer layer may be provided so as to make the grasping more comfortable. The circumferential surface that is grasped by the hand is the outside surface of the rigid body member or the outside surface of the softer outer layer if such outer layer is provided.

A ring like collar extending around the device at one end of each portion of the exercise devices may be provided to aid in retaining the hand during use.

The connecting structure utilized to connect the exercise devices to the exercise equipment may be a steel cable in the form of a loop as mounted to the end of the device to allow attachment to any desired exercise equipment.

The exercise devices may also be used as a handle in conjunction with other exercise equipment such as the various designs of cable machines, bar bell, dumbbell T-Bar and the like. For example, in a seated row exercise on a cable machine, the exercise which is primarily for exercising the back muscles as the target muscle group, conventionally designed handles are used in which the handles are grasped with the palms of the hands facing downward or facing each other. In using the exercise devices of the present invention in a seated row exercise, the axis of the exercise devices is aligned either horizontally or vertically with the fingers of the hand correspondingly aligned. As the hands pull on the exercise devices, both the targeted muscles of the back and the gripping muscles of the hands, wrist and forearm are also progressively strengthened as the above described routine of use is followed.

In performing dumbbell curls, which has the biceps muscles as the target muscles, in one of the conventional dumbbell curl exercise methods, the fingers of the hand are in a "C" grip at the start in a horizontal alignment with the index finger of each hand facing forward when the dumbbell is first grasped. As the curl movement progresses, the hand gradually moves through a vertical position wherein the fingers of the hand are arrayed in a vertical position until at the top of the curl the fingers are again aligned horizontally, but in the opposite directional array to that of the first grasping position. In using the exercise devices of the present invention in performing a dumbbell curl, the exercise devices are attached as handles to the dumbbell and the fingers of the hands are aligned in a vertical array with the index finger uppermost at all positions of the curl movement. Other alignments of the hand are also often used in performing dumbbell curls.

The exercise devices of the present invention may also be utilized as handles in performing T-Bar rows, dumbbell rows, shrugs, and on many cable exercise equipments. In using the exercise devices of the present invention, the exercise devices are attached, for example, to the bar of the dumbbells or the connector of the cables, with the central axis of the devices in a vertical or other desired orientation. The fingers of the hand are also aligned in a an array substantially parallel to the axis of the exercise devices and may stay in this alignment for the entire exercise.

The exercise devices of the present invention may also be used with other exercise equipments in a manner similar to that described above. However, for purposes of description herein, the device of the present invention are described in detail in the performance of a pull-up exercise, but are not so limited in their application and may be utilized in the performance of a variety of exercises on a variety of exercise equipments in which the hands are in the grasping position. In each of the uses of the exercise devices of the present invention, substantially all of the muscles utilized in the grasping are exercised in the isometric mode while the target muscles for each exercise are exercised in the isotonic mode.

It has been found that as the strength of the grip in any degree of openness of the hand is increased, the strength of the grip at any less of a degree of openness is also increased.

BRIEF DESCRIPTION OF THE DRAWING

The above and other embodiments of the present invention my be more fully understood from the following detailed description taken together with the accompanying drawing wherein similar reference characters refer to similar elements throughout and in which.

DESCRIPTION OF THE PREFERRED EMBODIMENTS

Figure 1:
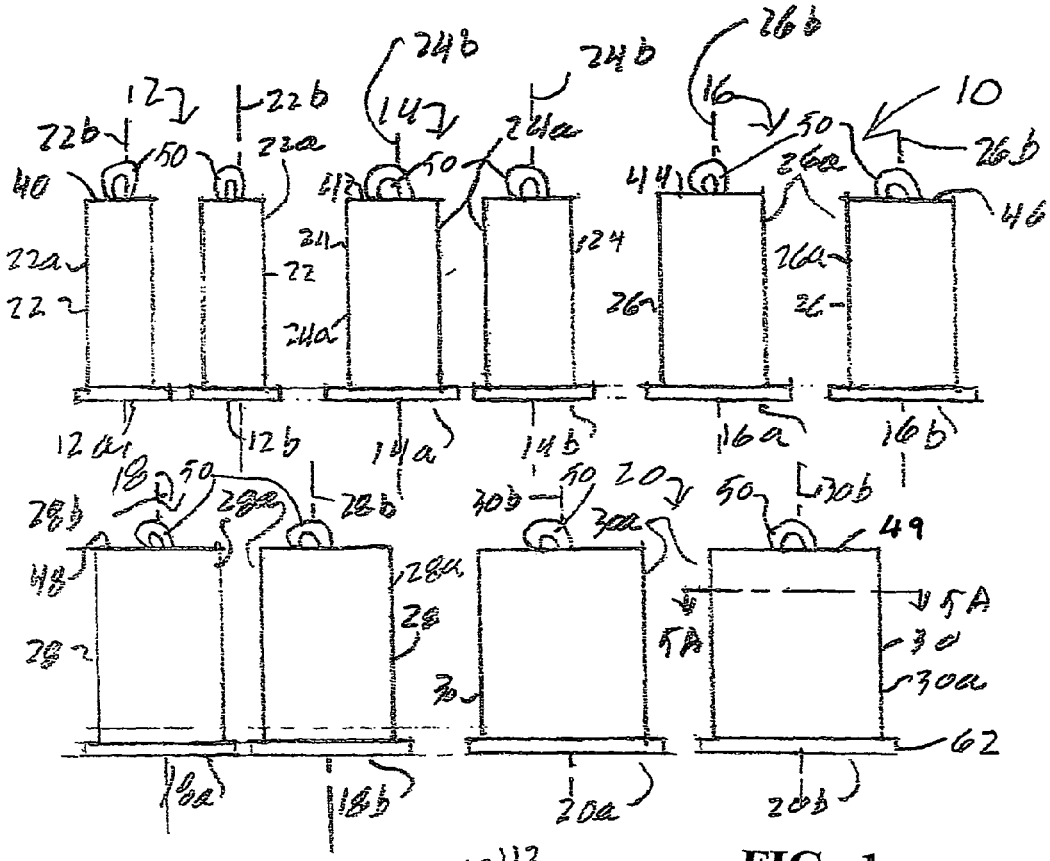
FIG. 1 illustrates a first embodiment of the present invention in which a plurality of pairs of devices are utilized.

Referring now to the drawing, there is illustrated in FIG. 1 a first preferred embodiment, generally designated 10 of the present invention. The embodiment 10 is comprised of a plurality of pairs of exercise devices indicated at 12, 14, 16, 18 and 20. While five such pairs of exercise devices are shown, embodiments of the present invention may have more than five pairs or less than five pairs. For example, the number of pairs of devices of embodiment 10 may as low as one pair and as high as ten or greater, depending on the desired use of the exercise devices. Each exercise device of each pair of exercise devices is substantially similar to the other exercise device of the pair. That is, exercise device 12*a* is substantially similar to exercise device 12*b*; exercise device 14*a* is substantially similar to exercise device 14*b*; exercise device 16*a* is substantially similar to exercise device 16*b*; exercise device 18*a* is substantially similar to exercise device 18*b*; and exercise device 20*a* is substantially similar to exercise device 20*b*.

Figure 5A:
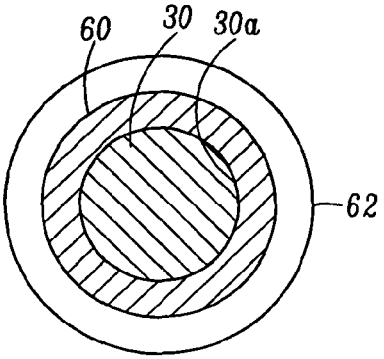
Figure 5B:
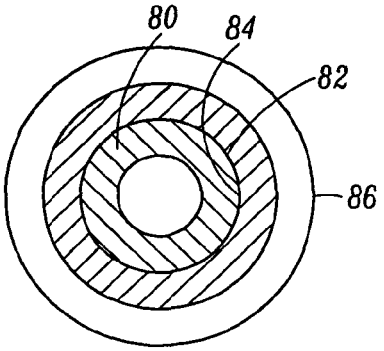

Each exercise device of each pair of exercise devices has a substantially rigid body member as indicated at 22, 24, 26, 28 and 30. The body members 22, 24, 26, 28 and 30 have an external circumferential surface as indicated at 22*a*, 24*a*, 26*a*, 28*a* and 30*a*. Each exercise device of the pairs of exercise devices of the embodiment 10 have a central axis as indicated at 22*b*, 24*b*, 26*b*, 28*b* and 30*b*. The external circumferential surfaces 22*a*, 24*a*, 26*a*, 28*a* and 30*a* are hand graspable and when grasped by the hand in either the "C" grip or the "Monkey Grip", the fingers of the hand are in an array along the axial length of the exercise device. Each exercise device of each pair of exercise devices 12, 14, 16, 18 and 20 are similarly constructed and may have a cross sectional configuration as shown in FIG. 5A or FIG. 5B. As shown in FIG. 5A for the exercise device 20*b*, the body member 30 is cylindrical and is a solid construction. In FIG. 5B the body member designated 80 may be tubular and the body members 22, 24, 26, 28 and 30 of embodiment 10 may also be tubular. Other geometrical cross sectional than the cylindrical cross section illustrated in FIGS. 5A and 5B may be selected as desired for particular applications as desired by the user. That is, the cross sectional configuration may be hexagonal, octagonal, oval or any other desired shape which may be conveniently grasped by the hand. Each of the exercise devices of the embodiment 10 of the present invention and the embodiments described below may also have any desired hand graspable cross sectional configuration. For the exercise devices of embodiment 10 being cylindrical in cross section, the diameter of the devices 12*a* and 12*b* may be on the order of ¾ of an inch, the diameter of the devices 14*a* and 14*b* may be on the order of 1 inch, the diameter of the devices 16*a* and 16*b* may be on the order of 1¼ inches, the diameter of the devices 18*a* and 18*b* may be on the order of 1½ inches and the diameter of the devices 20*a* and 20*b* may be on the order of 2 inches. For cross sectional configurations other than cylindrical, the circumferential surface may have a size that is generally the same as the circumferential surface of the corresponding cylindrical cross section. Other sizes for any of the portions may be selected as desired for particular applications.

The body members 22, 24, 26, 28 and 30 may be fabricated from metal, hard plastic or any other material suitable for the use.

The exercise devices of each embodiment of the present invention are utilized as the handle for connection to other conventional exercise equipments such as dumbbells, cables in cable machines, horizontal bars, or the like, conventionally utilized to exercise targeted muscles or muscle groups. In one configuration of use, each of the pairs of exercise devised 12*a* and 12*b*, 14*a* and 14*b*, 16*a* and 16*b*, 18*a* and 18*b* and 20*a* and 20*b* are fixedly connected at first ends 40, 42, 44, 46, 48 and 49 in a spaced array to a high horizontal bar with the central axes 22*b*, 24*b*, 26*b*, 28*b*, and 30*b* of the exercise devices in a vertical alignment. In other configuration of uses, the pairs of exercise devices of the present invention are removably connected to the horizontal bar in a sequential order as described below. In order to allow the removable connection, each of the exercise devices is provided with a loop like structure connection member 50 that, in preferred embodiments, are pivotally connected to the exercise devices allowing a swivel rotation of the exercise devices about their central axes relative to the connection member.

In performing the conventional pull-up, the hands grasp the outer surface of a high horizontal bar directly and the fingers of each hand are in a horizontal array along the bar. The target muscles, such as the back muscles, are then contracted to pull to pull the body or the user upward until the entire weight of the user is supported by the hands and the target muscles are in full or substantially full contraction. This portion of the exercise is generally termed the positive portion of the exercise. The degree of contraction of the target muscles is then lessened and the body of the user is slowly lowered down in a controlled manner which is generally termed the negative portion of the exercise. For maximum benefit, at least some degree of contraction of the target muscles is maintained during both the positive and negative portions of the exercise.

In using the present invention to perform a pull-up, a pair of the exercise devices are connected to the horizontal bar, with either a fixed or a removable connection and with the central axes in a vertical direction. The user grasps the circumferential surfaces of one of the pair of exercise devices in each hand. As noted above, the circumferential surface may be the circumferential surface of the body member or the circumferential surface of a softer body member, if such a cover is provided. Since the axes of the exercise devices are aligned in the vertical direction, the fingers of each hand are in a vertical array. The exercise devices are firmly grasped in either a "C" grip or a "Monkey" grip and the shoulder muscles of the back are contracted to lift the user's body upward to the desired maximum height. After peak contraction, the degree of contraction of the shoulder muscles is then gradually lessened and the body is slowly lowered to the start position with the devices of the present invention still grasped firmly during the lowering of the body.

In performing such a pull-up exercise using the exercise devices of the present invention as above described, the target muscles, such as the back muscles, are exercised in an isotonic mode while the grasping muscles of the hand and any auxiliary muscles of the wrist and/or forearm are exercised in an isometric mode.

The axial length of each of the exercise devices 12, 14, 16, 18 and 20 may be on the order of three to six inches, but greater or less size of the axial length may be selected for particular applications. The axial length of each exercise devices of the present invention is preferably at least the length of the hand between the outside edge of the little finger to the inside edge of the index finger.

In a prescribed routine for strengthening the grip of the hand, and using the pull-up as an example of such routine, the user first uses the pair of exercise devices having the smallest circumferential surface and performs the desired number of repetitions and sets for as many exercise sessions as necessary to provide the desired greater grip strength. As the grip strength at the degree of openness of the hand defined by the size of the first pair of exercise devices is increased over time by the isometric mode of exercise to the desired strength, the user then selects the pair of exercise devices having the next larger size which provides a greater degree of openness of the hand and the above routine is then followed. In any exercise session, the conventional pull-up exercise may, of course, be performed as well as the pull-up with the exercise devices of the present invention. As noted above, as the grip strength of the hand is increased at any degree of openness, the grip strength at any smaller amount of openness is also increased.

Since the body members of the exercise devices of the present invention are rigid, in some applications it has been found desirable to provide a relatively soft cover on the circumferential surface of the body member. As shown in FIG. 5A, the cover 60 surrounds the circumferential surface such as 30*a* and may, if desired be fabricated from, for example a flexible, resiliently deformable material such as a closed or open cell polyester based urethane polymer foam plastic and secured to the body member by adhesive or the like. Such a cover 60 provides improved grasping as the coefficient of friction thereof is generally greater than the coefficient of friction of the circumferential surface of the body member. As a further aid in preventing the slipping of the hand on the exercise devices of the present invention, a collar 62 may be provided at the second end of each exercise devices such as second end 20*b*. The collar has a greater circumference than the circumference of either the body member 30 or cover 60.

As noted above, the body member of the exercise devices of the present invention may be tubular instead of solid. Such construction is shown in FIG. 5B where there is shown a tubular body member 80 of an exercise devices 70 of the present invention which is tubular and may be provided with a cover 84 similar to the cover 6*o* described above on the circumferential surface 82 of the body member 80 as well as, if desired, a collar 86 similar to the collar 62 described above.

Figure 2:
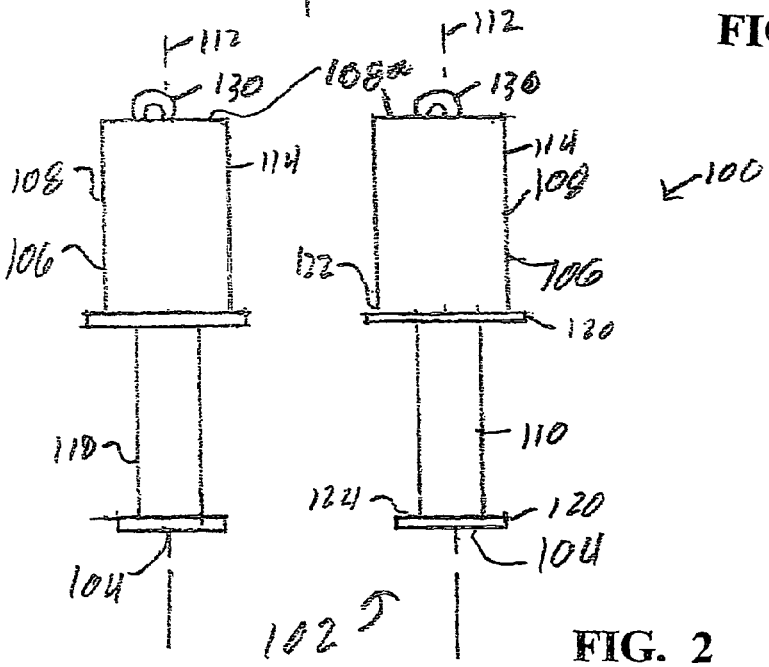
FIG. 2 illustrates another preferred embodiment of the present invention in which a single pair of devices is utilized.

FIG. 2 illustrates a second preferred embodiment, generally designated 100 of present invention. In the embodiment 100, there is shown a pair 102 of exercise devices 104. The exercise devices 104 are generally similar to the exercise devices 12, 14, 16, 18, and 20 above except that the body members 106 have two portions 108 and 110 and a central axis 112. The first portion 108 has a hand graspable circumference 114 having a first preselected circumference and the second portion 110 has a second preselected circumference that is smaller the first preselected circumference. The exercise devices 104 are thus a combination of, for example, exercise devices 12 of FIG. 1 connected to exercised devices 14 of FIG. 1, so that the axes are collinear to define the central axes 112 thereof.

A connection member 130 similar to the connection member 50 described above may be provided at the first end 108*a* of the portion 108 of the exercise devices 104. The connection member 130 may be fixed to the portion 108 or may be pivotally connected to the portion 108 of exercise device 104 to allow a swivel rotation of the exercise devices about their central axes relative to the connection member.

The use of the exercise devices 104 may be the same as described above for the exercise devices of embodiment 10. In embodiment 100, the exercise devices 104 may be provided in a plurality of pairs of exercise devices and may be provided with any variation in size as desired for particular applications. The number of the plurality of pairs of exercise devices may be, for example, more or less than five pairs. For example, if five pair of exercise devices 104 are provided, there will be ten sizes of openness of the hand to be sequentially used as the grip strength is increased. Connection member 130, which may be similar to connections members 50 described above and may be a braided wire loop, may also be connected to the exercise devices 104 to be either fixed or pivotally connected for rotation about the central axes 112. One or both of a cover similar to the covers 60 and 84 shown on FIGS. 5A and 5B and collars 120 similar to collars 62 and 86 of FIGS. 5A and 5B may be provided.

The connection of the portion 110 to the portion 108 in exercise devices 104 may be fixed or removable. To provide the removable connection there may be a threaded connection therebetween (not shown on FIG. 2).

Figure 3:
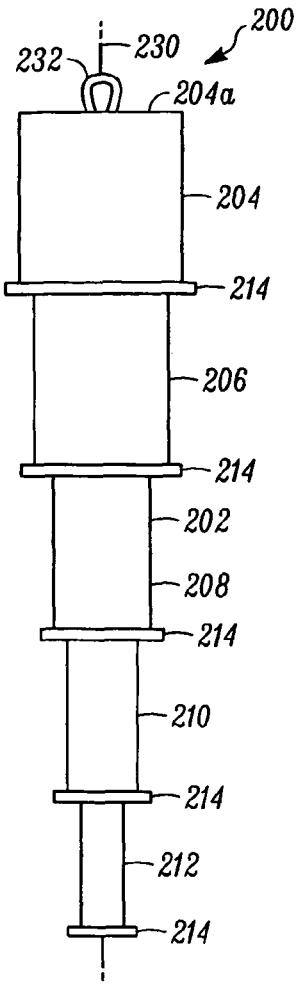
FIG. 3 illustrates another preferred embodiment of the present invention.

FIG. 3 illustrates a third preferred embodiment generally designated 200 of an exercise device 202 according to the principles of the present invention. The exercise devices 202 is similar to the exercise devices 104 of FIG. 2 except that five separate portions 204, 206, 208, 210 and 212 are connected together to have a common central axis 230. The portions 204, 206, 208, 210 and 212 are generally similar to the exercise devices 20, 18, 16, 14 and 12, respectively, described above in connection with embodiment 10 and are connected together as described in embodiment 100. The connection between the portions 204, 206, 208, 210 and 212 may be fixed or may be removable as described above. Each of the portions 204, 206, 208, 210 and 212 may be provided with a cover and/or a collar 214 similar to the collars 62 of FIG. 5A and 84 of FIG. 5B. Each of the portions 204, 206, 208, 210 and 212 are constructed in a manner similar to the construction of the exercise devices 20, 18, 16, 14 and 12, respectively. The exercise device 202 shown on FIG. 3 is one of a pair of similar exercise devices as used in various exercises as described above.

A connection member 232 similar to the connection member 50 described above may be provided at the first end 204*a* of the portion 204 of the exercise device 202. The connection member 232 may be fixed to the portion 204 or may be pivotally connected to the portion 204 of exercise device 202 to allow a swivel rotation of the exercise device 202 about the central axis 230 relative to the connection member 232. In use, exercises using a pair of the exercise devices 202, or a single exercise device 202 in the case of one handed exercises such as dumbbell rows, starts with grasping the smallest circumferential surface at portion 212 and progress sequentially to the larger circumferences of portions 210, 208, 206 and 204 as the grip strength is increased. For the exercise devices of embodiment 200, if the portions 204, 206, 208, 210 and 212 are generally cylindrical in cross section, the portion 212 may have a diameter of ¾ of an inch, the portion 210 may have a diameter on the order of 1 inch, the portion 208 may have a diameter on the order of 1 and ¼ inches, the portion 206 may have a diameter on the order of 1 and ½ inches and the portion 204 may have a diameter on the order of 2 inches. The size of the circumferential surface for geometrical shapes of the portions 212, 210, 208, 206 and 204 other than cylindrical may be selected so as to be generally about the same as the corresponding circumferential surfaces for cylindrical geometrical cross sections.

Dimensions for each of the portions 212, 210, 208, 206 and 204 other than the dimensions set out above may be selected for the exercise devices of 202 to be used in particular applications.

Figure 4:
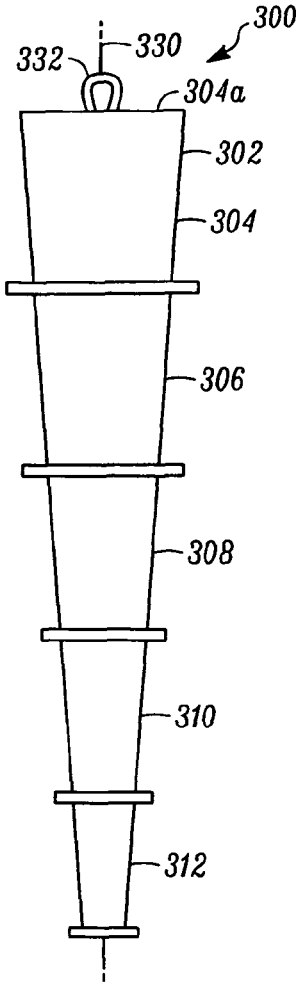
FIG. 4 illustrates another preferred embodiment of the present invention; and, FIGS. 5A and 5B illustrates a cross sectional view of the devices of the present invention.

FIG. 4 shows another preferred embodiment generally designated 300 of the present invention of an exercise device 302 which may be one of a pair of exercise devices 302 as used in the methods of use described herein. The exercise device 302 has portions 304, 306, 308, 310 and 312 which are generally similar to the portions 204, 206, 208, 210 and 212 described above in connection with the embodiment 200 except that each portion 304, 306, 308, 310 and 312 are conical frustums connected together to have a common central axis 330.

In use, exercises using a pair of the exercise devices 302 starts with using the smallest circumferential surface at portion 312 and progresses sequentially to the larger circumferential surface of portions 310, 308, 306 and 304 as the grip strength is increased.

A connection member 332 similar to the connection members 50, 130 and 232 described above may be provided at the first end 304*a* of the portion 304 of the exercise device 302. The connection member 332 may be fixed to the portion 304 or may be pivotally connected to the portion 304 of exercise device 302 to allow a swivel rotation of the exercise device 302 about the central axis 330 relative to the connection member 332.

For the portions 304, 306, 308, 310 and 312 being frustums of right circular cones, the smaller end of portion 312 may have a diameter on the order of ¾ inch, the larger end of portion 312 and the smaller end of portion 310 may have a diameter of 1 inch, the larger end of portion 310 and the smaller end of portion 308 may have a diameter on the order of 1¼ inches, the larger end of portion 308 and the smaller end of portion 306 may have a diameter on the order 1½ inches, the larger end of portion 306 and the smaller end of portion 304 may have a diameter on the order of 2 inches and the larger end of portion 304 may have a diameter on the order 2½ inches.

The size of the circumferential surface for geometrical shapes other than right circular conical frustums of the portions 312, 310, 308, 306 and 304 may be selected so as to be generally about the same as the corresponding circumferential surfaces of the frustums of right circular conical portions.

Dimensions for each of the portions 312, 310, 308, 306 and 304 other than the dimensions set out above may be selected for the exercise devices 302 to be used in particular applications.

The axial length of each portion of the exercise devices 100, 200 and 300 may be on the order of three to six inches though greater of smaller axial lengths may be selected for desired applications.

As can be seen from the above description, there has been described a new exercise device for providing an increase in the grip strength of the hand of a user. The exercise devices of the present invention may be economically fabricated and provided in a single pair or multiple pairs of exercise devices as may be desired for particular applications. The exercise devices of the present invention are utilized as handles to connect to other exercise equipments of the type found in health clubs and the like. Use of the exercise devices of the present invention in connection with the other exercise equipments provides a grip strengthening isometric mode of exercise of the grip muscles while the target muscles of the particular exercise in which exercise devices of the present invention are used as handle are exercised in the isotonic mode.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

What is claimed is:

1. A progressive hand grip strengthening system for strengthening the hand grip of a user in an isometric mode while other muscles of the user are being strengthened in an isotonic mode by a separate exercise equipment to which the hand grip strengthening system is connected, the hand grip strengthening system comprising:

a plurality of differently sized and weighted hand-graspable devices each connectable to a separate pre-selected exercise equipment and each hand-graspable device comprising:

a first portion having a hand-graspable surface having a pre-selected circumference;

a second portion having a hand-graspable surface having a pre-selected circumference that is smaller than the pre-selected circumference of the first portion;

and a connection member, wherein the first and second portions each comprise a rigid body member having a central axis, wherein the axis of the first and second portions is co-linear to define a central axis of the hand-graspable device, spaced apart first and second ends, a hand-graspable outer surface having a pre-selected circumference and shape between the first and second ends of the rigid body member for receiving fingers of a user's hand in any degree of openness in planes parallel to the central axis, and a collar member coupled to a second end of the body member, and wherein the connection member extends from the first end of the rigid body member of the first portion to connect the exercise device to the separate exercise equipment, and the connection member is pivotally coupled to the first end of the rigid body member of the first portion to allow rotational movement of the hand-graspable device about its central axis with relative to its connection member.

2. The progressive handgrip strengthening system of claim 1 wherein each rigid body member further comprises a cover member on the circumferential outer surface thereof.

3. A progressive hand grip strengthening system for strengthening the hand grip of a user in an isometric mode while other muscles of the user are being strengthened in an isotonic mode by a separate exercise equipment to which the hand grip strengthening system is connected, the hand grip strengthening system comprising:

a plurality of differently sized and weighted hand-graspable devices each connectable to a separate pre-selected exercise equipment and each hand-graspable device comprising:

a first portion having a hand-graspable surface having a pre-selected circumference;

a second portion having a hand-graspable surface having a pre-selected circumference that is smaller than the pre-selected circumference of the first portion;

and a connection member, wherein the first and second portions each comprise a conical frustum of different dimensions on a common axis, a rigid body member having a central axis, wherein the axis of the first and second portions is co-linear to define a central axis of the hand-graspable device, spaced apart first and second ends, a hand-graspable outer surface having a pre-selected circumference and shape between the first and second ends of the rigid body member for receiving fingers of a user's hand in any degree of openness, and a collar member coupled to a second end of the body member, and wherein the connection member extends from the first end of the rigid body member of the first portion to connect the exercise device to the separate exercise equipment, and the connection member is pivotally coupled to the first end of the rigid body member of the first portion to allow rotational movement of the hand-graspable device about its central axis with relative to its connection member.

4. The progressive handgrip strengthening system of claim 3 wherein each rigid body member further comprises a cover member on the circumferential outer surface thereof.

* * * * *